US008912417B2

(12) United States Patent
Krol et al.

(10) Patent No.: US 8,912,417 B2
(45) Date of Patent: Dec. 16, 2014

(54) MUTABLE HIGH-HAT TAMBOURINE

(71) Applicants: Andrzej Krol, Wayne, NJ (US); Victor Filonovich, Clifton, NJ (US); Sergio Bonsignore, Ridgewood, NY (US)

(72) Inventors: Andrzej Krol, Wayne, NJ (US); Victor Filonovich, Clifton, NJ (US); Sergio Bonsignore, Ridgewood, NY (US)

(73) Assignee: KMC Music, Inc., Bloomfield, CT (US)

( * ) Notice: Subject to any disclaimer, the term of this patent is extended or adjusted under 35 U.S.C. 154(b) by 0 days.

(21) Appl. No.: 13/844,045

(22) Filed: Mar. 15, 2013

(65) Prior Publication Data

US 2014/0260895 A1 Sep. 18, 2014

(51) Int. Cl.
*G10D 13/02* (2006.01)

(52) U.S. Cl.
CPC ..... *G10D 13/02* (2013.01)
USPC ..... 84/418

(58) Field of Classification Search
USPC ..... 84/402, 418
See application file for complete search history.

(56) References Cited

U.S. PATENT DOCUMENTS 3,592,097 A 7/1971 Friede
4,244,267 A 1/1981 Nemeth
6,316,709 B1 11/2001 Nanberg et al.
2006/0016320 A1* 1/2006 Petrella ..... 84/418
2009/0178538 A1* 7/2009 van der Meulen ..... 84/418

OTHER PUBLICATIONS

Rhythm Tech, http://www.samash.com/p/Rhythm%20Tech__%22Hat%20Trick%22%20G2%20Hi-Hat%20Tambourine%20with%20Brass%20Jingles!__-49946523?cm_mmc=Shopzilla-__-Drums-__-Channeladvisor-__-Rhythm+Tech+%22Hat+Trick%22+G2+Hi-Hat+Tambourine+with+Brass+Jingles!&utm_source=SZS&utm_medium=CSE&utm_campaign=Channeladvisor.
Ralph Kester, http://www.ebay.co.uk/itm/Ralph-Kester-Reproduction-Ching-Ring-Hi-Hat-Tambourine-Bonham-BONZO-/110985011582?pt=LH_DefaultDomain_0&hash=item19d738e17e.
Pearl Percussion, http://www.pearldrum.com/Products/Percussion/Hand-Percussion/Tambourines-TomBourines.aspx.

* cited by examiner

*Primary Examiner* — Kimberly Lockett
(74) *Attorney, Agent, or Firm* — Hudnell Law Group P.C.

(57) ABSTRACT

Systems, methods, and apparatuses that allow for a high-hat mounted tambourine musical instrument to be muted are disclosed. In an aspect, the present disclosure provides a mutable tambourine jingle assembly that can be permanently engaged with the press of a button or otherwise. As such, the need for a user to physically hold the tambourine or an attached lever (e.g., a foot pedal) to mute the jingle assembly is obviated. In another aspect of the present disclosure, apparatuses are provided that facilitate a user simultaneously muting all of the jingles of a hi-hat mounted tambourine.

18 Claims, 7 Drawing Sheets

MUTABLE HIGH-HAT TAMBOURINE

FIELD OF THE DISCLOSURE

The present disclosure generally relates to musical instruments and more particularly to systems, methods and apparatuses for facilitating the muting of percussion musical instruments such as a tambourine.

BACKGROUND

The statements in this section merely provide background information related to the present disclosure and may not constitute prior art.

Percussion musical instruments capable of creating a sounds and rhythms are known in the art. One type of percussion musical instrument—the tambourine—has been used since ancient times and today can be found in many forms of music (e.g., Greek folk music, Italian folk music, classical music, Persian music, gospel music, pop music and rock music).

A typical tambourine consists of a frame, often made of wood or plastic, with pairs of small metal jingles (also called "zils") and may also include a drumhead. Tambourines come in many shapes, with the most common being circular or substantially semi-circular.

In order to play a tambourine, it is typically held in a user's hand and shaken, struck with the user's other hand, struck with a drum stick or other percussion tool, struck into the user's leg or hip, or a combination of two or more of the aforementioned techniques. When a user must use their hand or hands to play the tambourine, however, those hands are no longer available to play other percussion instruments. This is especially problematic because tambourines are often used in conjunction with other percussion instruments (e.g., drums). Thus, many tambourines are designed to be mounted to a drum set's high-hat rod. This allows a user to play the tambourine with a single foot pedal and frees their hands (and other foot) to play the drums as normal. This style of tambourine play is typically referred to as a "high-hat tambourine shake" technique.

Once a tambourine is mounted onto a high-hat rod, its jingles are subject to vibration from the user's other percussion instruments, and even vibration from the instruments being used by other members of the user's band. This produces unwanted and ill-timed sounds and rhythms during the course of a performance or musical work sound recording.

Given the foregoing, systems, methods, and apparatuses are needed that allow for a high-hat mounted tambourine to be muted.

SUMMARY

This Summary is provided to introduce a selection of concepts. These concepts are further described below in the Detailed Description section. This Summary is not intended to identify key features or essential features of this disclosure's subject matter, nor is this Summary intended as an aid in determining the scope of the disclosed subject matter.

Aspects of the present disclosure meet the above-identified needs by providing systems, methods, and apparatuses that allow for a high-hat mounted tambourine to be muted. In one aspect, the present disclosure provides a mutable tambourine jingle assembly that can be permanently engaged with the press of a button or otherwise. As such, the need for a user to physically hold the tambourine or an attached lever (e.g., foot pedal) to mute the jingle assembly is obviated.

Further features and advantages of the present disclosure, as well as the structure and operation of various aspects of the present disclosure, are described in detail below with reference to the accompanying drawings.

BRIEF DESCRIPTION OF THE DRAWINGS

The features and advantages of the present disclosure will become more apparent from the Detailed Description set forth below when taken in conjunction with the drawings in which like reference numbers indicate identical or functionally similar elements.

DETAILED DESCRIPTION

The present disclosure is directed to systems, methods, and apparatuses that allow for a high-hat mounted tambourine to be muted. In one aspect, the present disclosure provides a mutable tambourine jingle assembly that can be permanently engaged with the press of a button or otherwise. As such, the need for a user to physically hold the tambourine or an attached lever to mute the jingle assembly is obviated.

In another aspect of the present disclosure, apparatuses are provided that facilitate a user muting all of the jingles of a hi-hat tambourine simultaneously.

Figure 1:
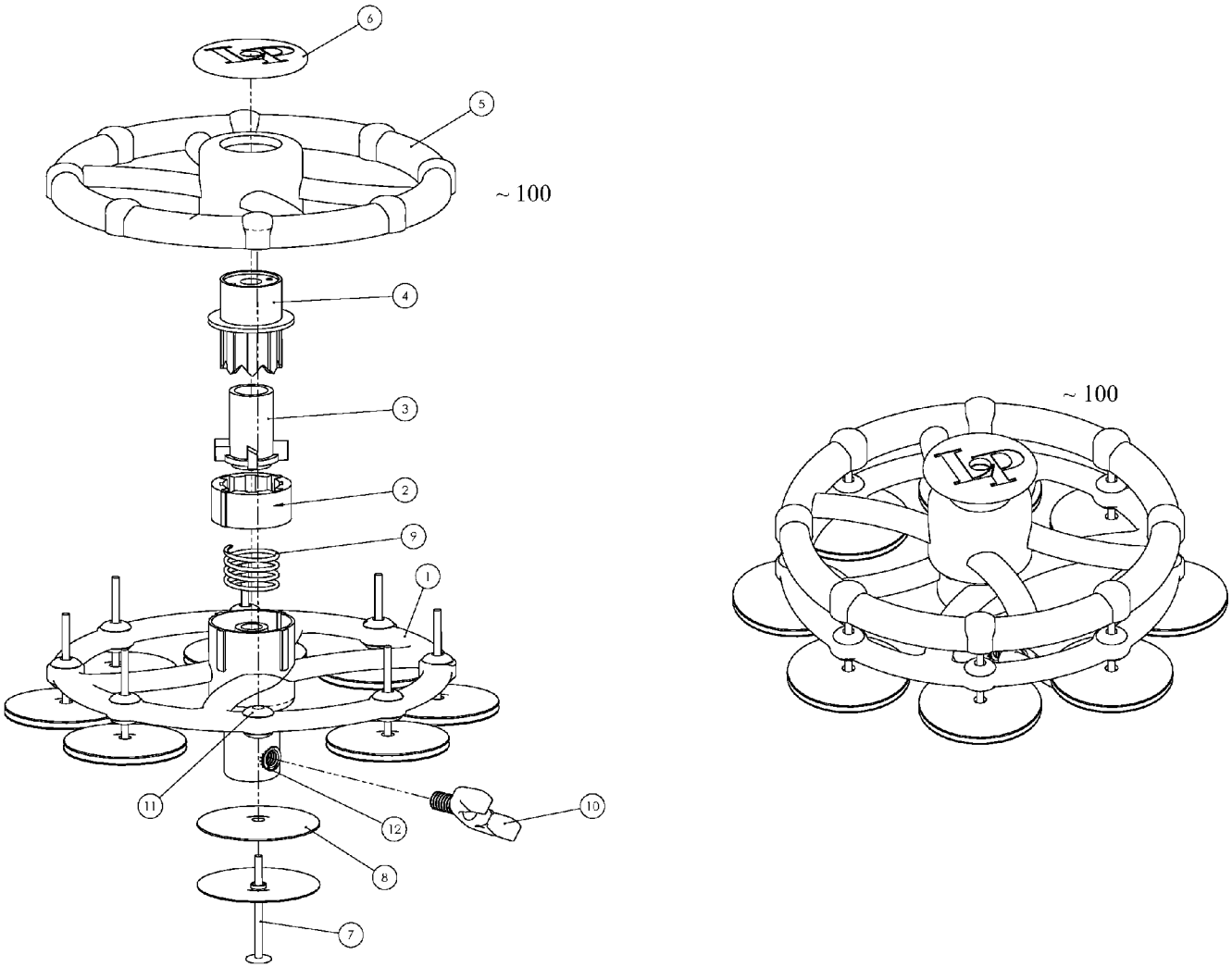
FIG. 1 is a block diagram of a mutable high-hat tambourine assembly, according to one aspect of the present disclosure.

Referring to FIG. 1, a block diagram of a mutable high-hat tambourine assembly 100, according to one aspect of the present disclosure, is shown. (As will be appreciated by those skilled in the relevant art(s), assembly 100 is shown fully-assembled in a perspective view on the right portion of FIG. 1, and disassembled in an exploded view to highlight its component parts on the left portion of FIG. 1.)

Assembly 100 comprises a PEM® threaded insert 12 (available from Penn Engineering & Manufacturing Corp. of Danboro, Pa.) and a wing screw 10 (e.g., a ¼-20×½" wing screw) so that tambourine assembly 100 can be removably attached or coupled to a drum set's high-hat rod (i.e., stand).

Figure 4:
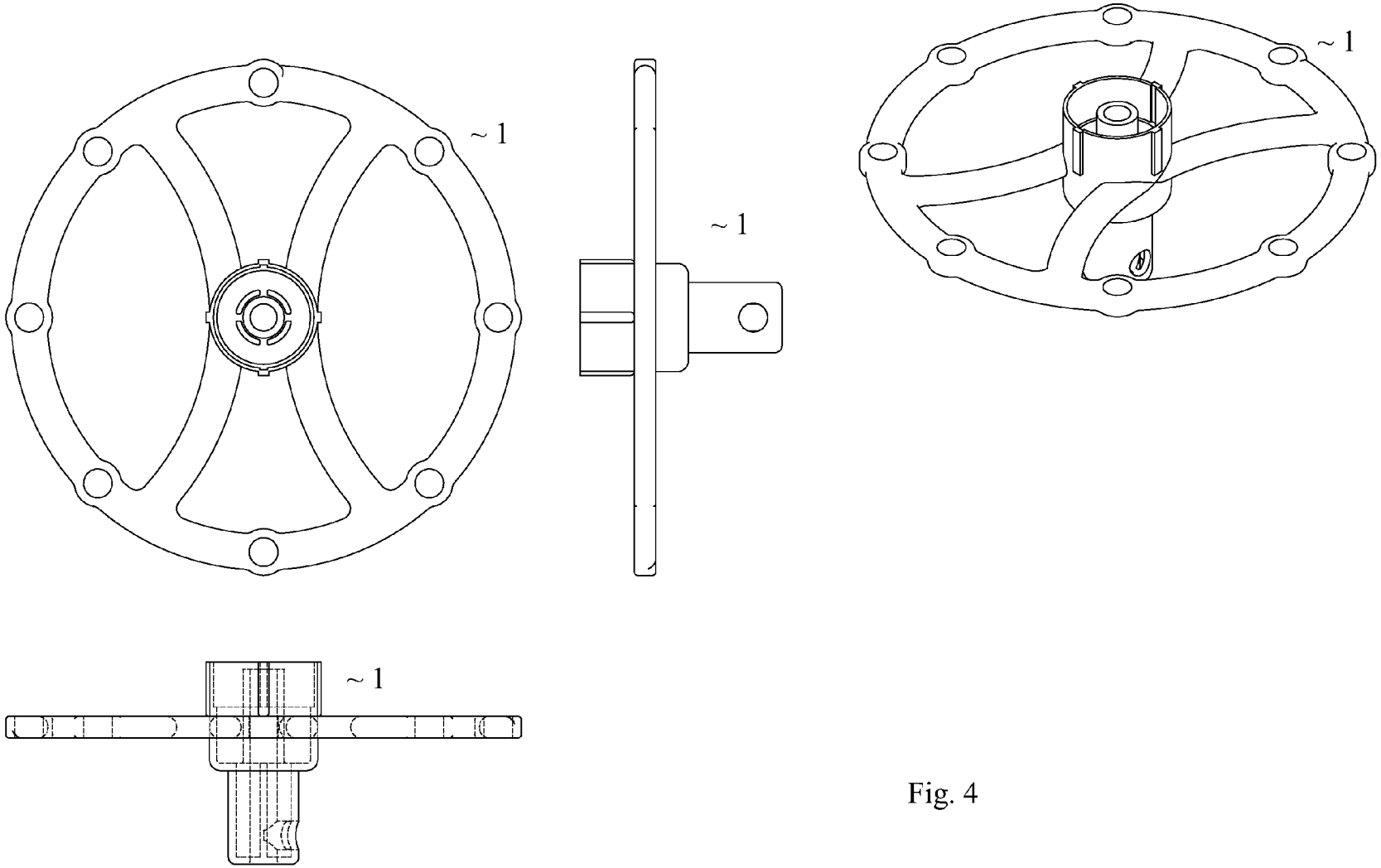
FIG. 4 is block diagram of a main body of a mutable high-hat tambourine assembly, according to one aspect of the present disclosure.

Assembly 100 further comprises a circular main body 1 (shown in a more detailed view in FIG. 4) with eight evenly-spaced pin holes that can receive eight jingle pins 7 to attach in a suspended fashion eight pairs of jingles 8.

Figure 3:
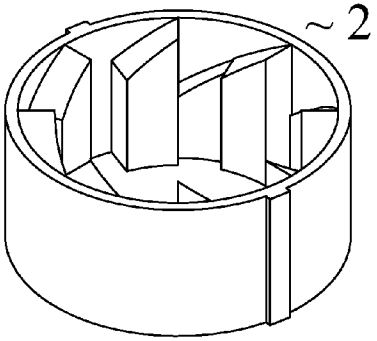
FIG. 3 is block diagram of an internal ring for a mutable high-hat tambourine assembly, according to one aspect of the present disclosure.
Figure 3:
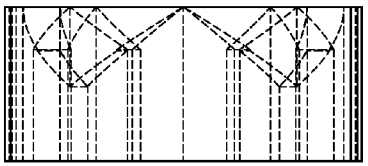
Figure 3:
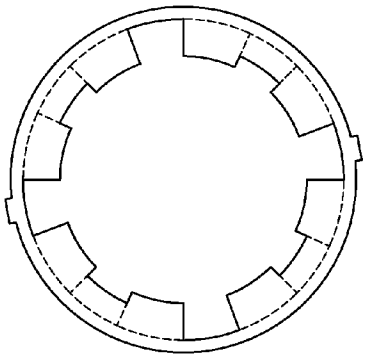
Figure 5:
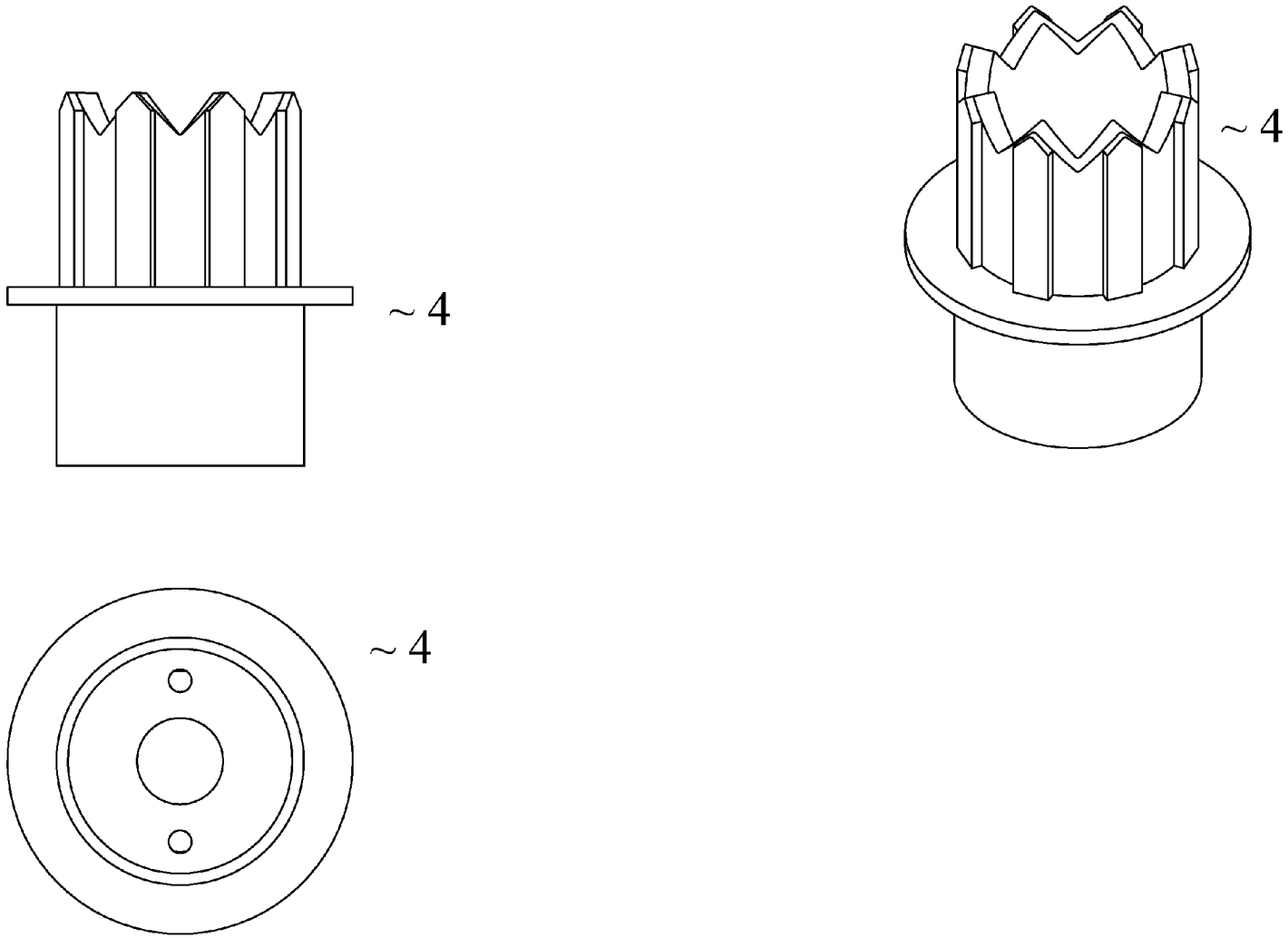
FIG. 5 is block diagram of a rotator for a mutable high-hat tambourine assembly, according to one aspect of the present disclosure.
Figure 6:
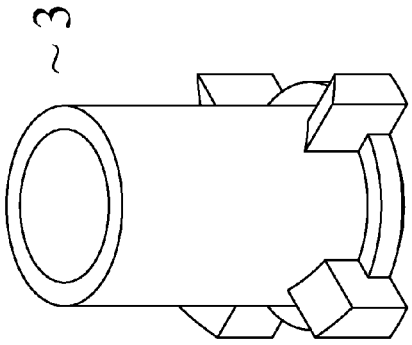
FIG. 6 is block diagram of a shifter for mutable high-hat tambourine assembly, according to one aspect of the present disclosure.
Figure 6:
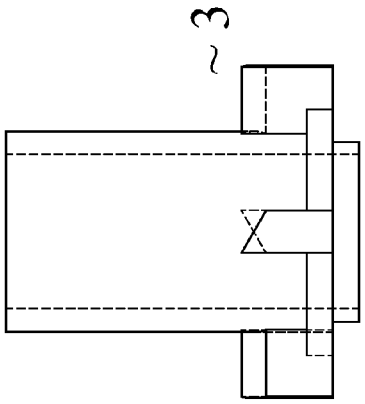
Figure 6:
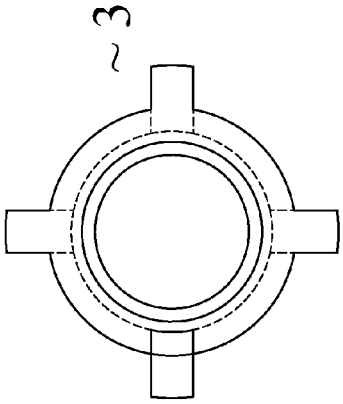

In one aspect, the center of main body 1 (i.e., the hub connected to the outer ring by two or more spokes) contains a circular hollow housing or cavity in which a rotator 4 (shown in a more detailed view in FIG. 5), a shifter 3 (shown in a more detailed view in FIG. 6), an internal ring 2 (shown in a more detailed view in FIG. 3) and a spring 9 are placed in top-to-bottom order.

Figure 7:
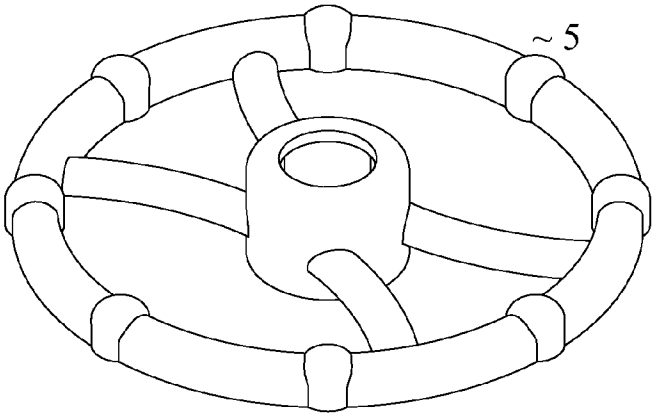
FIG. 7 is block diagram of a top body for mutable high-hat tambourine assembly, according to one aspect of the present disclosure.
Figure 7:
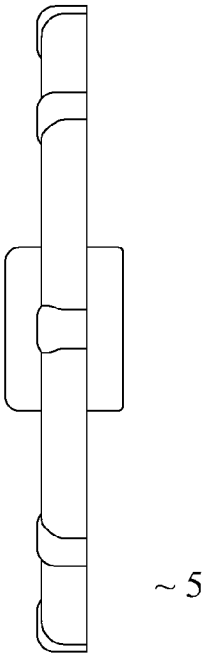
Figure 7:
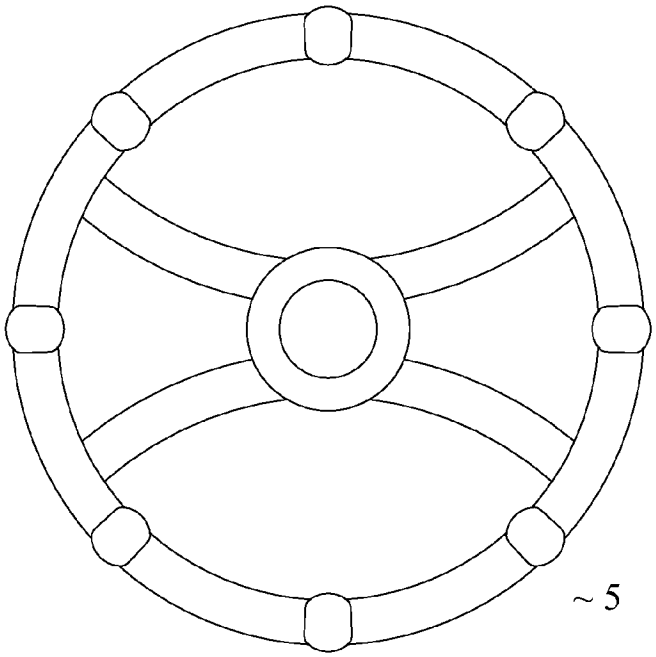
Figure 7:
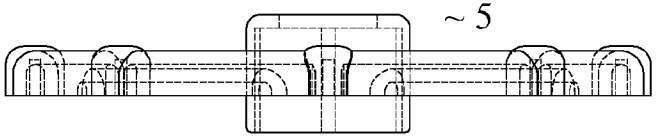

Assembly 100 further comprises a top body 5 (shown in a more detailed view in FIG. 7) having an equal circumference to main body 1 such that the eight jingle pins 7 may be inserted through the eight pairs of jingles 8 respectively and then through main body 1 and into top body 5 in a bottom-to-top order. Top body 5 also contains a hollow hub so that it may receive rotator 4, shifter 3, internal ring 2 and spring 9, when top body 1 is coupled to main body 1.

In one aspect, each jingle pin 7 is inserted through a rubber grommet 11 which protects the pierced material (i.e., the metal or other rigid material from which main body 1 is constructed) from abrasion from jingle pins 7 as they interface and are inserted through the pin holes found within main body 1.

As will be appreciated by those skilled in the relevant art(s) after reading the description herein, main body 1 (and thus top body 5) may be manufactured from any metal, plastic, wood or other rigid material in varying circumferences, and thus may contain a varying number and size of evenly-spaced jingle pairs.

Figure 2:
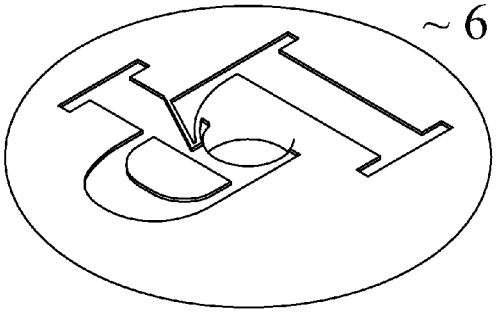
FIG. 2 is block diagram of a cap for a mutable high-hat tambourine assembly, according to one aspect of the present disclosure.
Figure 2:
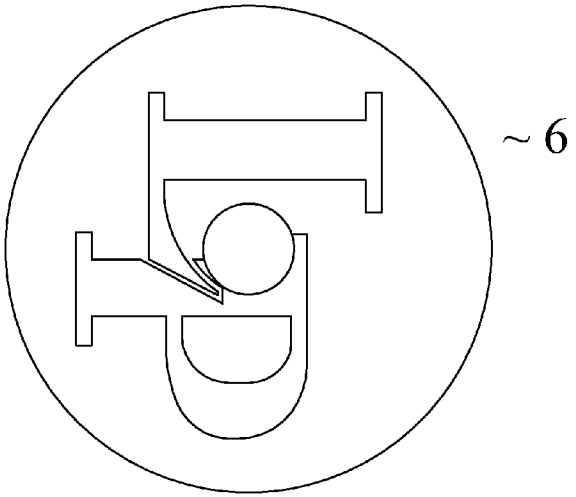
Figure 2:
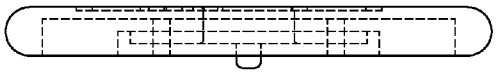

In operation, according to one aspect of the present disclosure, a user may depress cap 6 (shown with a logo design in a detailed view in FIG. 2) once thereby causing assembly 100 to compress. That is, pressing cap 6 causes the distance between main body 1 and top body 5 to decrease. This causes all of the jingle pairs 8 to simultaneously compress by sliding along jingle pins 7 towards each other and therefore become muffled or muted. As such, the need for the user to physically hold tambourine 100 or an attached lever (e.g., the foot pedal attached to the high-hat rod) to mute jingles 8 is obviated.

In such an aspect, the user may depress cap 6 once again to thereby cause assembly 100 to decompress. That is, pressing cap 6 for a second time causes the distance between main body 1 and top body 5 to increase. This causes all of the jingle pairs 8 to simultaneously decompress by sliding along jingle pins 7 away from each other and therefore become un-muffled or unmuted. Thus, cap 6 acts in a toggle manner to mute and unmute jingles 8 within assembly 100.

As will be appreciated by those skilled in the relevant art(s) after reading the description herein, cap 6 may be depressed or toggled directly by a user's hand or indirectly by a percussion tool or accessory (e.g., a drum stick) utilized by the user.

As will be also be appreciated by those skilled in the relevant art(s) after reading the description herein, in alternate aspects, cap 6 may be pressed downward and pulled upward in order to mute and unmute, respectively, jingles 8 within assembly 100.

While various aspects of the present disclosure have been described above, it should be understood that they have been presented by way of example and not limitation. It will be apparent to persons skilled in the relevant art(s) that various changes in form and detail can be made therein without departing from the spirit and scope of the present disclosure. Thus, the present disclosure should not be limited by any of the above described exemplary aspects, but should be defined only in accordance with the following claims and their equivalents.

In addition, it should be understood that the figures in the attachments, which highlight the structure, methodology, functionality and advantages of the present disclosure, are presented for example purposes only. The present disclosure is sufficiently flexible and configurable, such that it may be implemented in ways other than that shown in the accompanying figures (e.g., implementations embodied as percussion instruments other than those mentioned herein). As will be appreciated by those skilled in the relevant art(s) after reading the description herein, certain features from different aspects of the systems, methods and apparatuses of the present disclosure may be combined to form yet new aspects of the present disclosure.

Further, the purpose of the foregoing Abstract is to enable the U.S. Patent and Trademark Office and the public generally and especially the scientists, engineers and practitioners in the relevant art(s) who are not familiar with patent or legal terms or phraseology, to determine quickly from a cursory inspection the nature and essence of this technical disclosure. The Abstract is not intended to be limiting as to the scope of the present disclosure in any way.

What is claimed is:

1. A tambourine capable of being muted by a user, comprising:

attaching means for attaching the tambourine to a high-hat stand;

a main body, coupled to said attaching means, wherein said main body includes a plurality of pin holes;

a plurality of jingle pairs;

a plurality of jingle pins, wherein each of said plurality of jingle pins suspends a respective one of said plurality of jingle pairs from said main body at a respective one of said plurality of pin holes;

a top body coupled to said main body by said plurality of jingle pins; and a cap coupled to said top body;

wherein musical sounds are produced when each of said plurality of jingle pairs strike each other when the tambourine is moved;

wherein said cap is configured to simultaneously mute each of said plurality of jingle pairs by compressing the distance between said main body and said top body when said cap is depressed by the user a first time; and wherein said cap is configured, to simultaneously unmute each of said plurality of jingle pairs by decompressing the distance between said main body and said top body when said cap is depressed by the user a second time.

2. The tambourine of claim 1, wherein the shape of said main body and said top body is circular.

3. The tambourine of claim 2, wherein said main body and said top body each contain a plurality of spokes and a hollow cavity hub.

4. The tambourine of claim 3, wherein said main body and said top body are each constructed from at least one metal.

5. The tambourine of claim 4, wherein said plurality of pin holes are evenly spaced across said main body.

6. The tambourine of claim 5, wherein said top body and said main body are coupled at their respective said hollow cavity hubs.

7. The tambourine of claim 6, wherein: said top body and said main body are coupled, by said plurality of jingle pins, at their respective said hollow cavity hubs; and their respective said hollow cavity hubs collectively house at least a rotator, a shifter, an internal ring and a spring.

8. The tambourine of claim 1, wherein the shape of said main body and said top body is substantially semi-circular.

9. The tambourine of claim 1, wherein said main body and said top body are constructed from plastic.

10. The tambourine of claim 1, wherein said main body and said top body are constructed from wood.

11. A mutable percussion instrument, comprising:

a main body which includes a plurality of pin holes;

a plurality of jingle pairs;

a plurality of jingle pins, wherein each of said plurality of jingle pins suspends a respective one of said plurality of jingle pairs from said main body at a respective one of said plurality of pin holes;

a top body coupled to said main body by said plurality of jingle pins;

a cap coupled to said top body, wherein said cap is configured to simultaneously mute each of said plurality of jingle pairs by compressing the distance between said main body and said top body when it is depressed by a user a first time; and wherein said cap is configured, to simultaneously unmute each of said plurality of jingle pairs by decompressing the distance between said main body and said top body when said cap is depressed by the user a second time.

12. The mutable percussion instrument of claim 11, wherein musical sounds are produced when each of said plurality of jingle pairs strike each other when the instrument is moved.

13. The mutable percussion instrument of claim 11, further comprising:

a drumhead;

wherein musical sounds are produced when each of said plurality of jingle pairs strike each other as a result of at least one of: a user moving the instrument; and a user striking said drumhead.

14. The mutable percussion instrument of claim 11, wherein said main body and said top body are each constructed from at least one of: a metal; a plastic;

and a wood.

15. The mutable percussion instrument of claim 11, further comprising:

attaching means for attaching the instrument to a high-hat stand.

16. The mutable percussion instrument of claim 11, wherein the shape of said main body and said top body is circular.

17. The mutable percussion instrument of claim 16, wherein said main body and said top body each contain a plurality of spokes and a hollow cavity hub.

18. The mutable percussion instrument of claim 17, wherein: said top body and said main body are coupled, by said plurality of jingle pins, at their respective said hollow cavity hubs; and their respective said hollow cavity hubs collectively house at least a rotator, a shifter, an internal ring and a spring.

* * * * *